United States Patent [19]

Ruchser et al.

[11] 4,269,225

[45] May 26, 1981

[54] SAFETY VALVE ASSEMBLY

[75] Inventors: Erich Ruchser, Kernen; Helmut Ott, Stuttgart, both of Fed. Rep. of Germany

[73] Assignee: Technomatic AG, Aesch/Luzern, Switzerland

[21] Appl. No.: 969,482

[22] Filed: Dec. 14, 1978

[30] Foreign Application Priority Data

Dec. 16, 1977 [DE] Fed. Rep. of Germany ..... 2756240
Mar. 16, 1978 [DE] Fed. Rep. of Germany ..... 2811374

[51] Int. Cl.[3] ..... F15B 13/043; F15B 20/00

[52] U.S. Cl. ..... 137/596.16; 91/424; 91/448; 137/596.18

[58] Field of Search ..... 91/424, 448; 137/596.16, 596.18

[56] References Cited

U.S. PATENT DOCUMENTS 3,108,612 10/1963 Hofmann et al. ..... 137/596.16
3,283,862 11/1966 Warnock ..... 137/596.16

FOREIGN PATENT DOCUMENTS 1294747 11/1972 United Kingdom ..... 137/596.16

*Primary Examiner*—Gerald A. Michalsky
*Attorney, Agent, or Firm*—Michael J. Striker

[57] ABSTRACT

A safety valve assembly for pressurized medium-operated devices has two valves operating in parallel with one another and each having a working piston and a valve member. The assembly has a housing provided with a supply inlet, a consumer outlet and a discharge outlet. The valve members of the valves are guided in chambers provided in the housing and communicating with one another by passages which crosswise connect the chambers. The valve members in the chambers establish or interrupt communication between the inlet and outlets. When a malfunction occurs, at least one valve member blocks the cross passages so that the consumer outlet does not communicate with the inlet but, instead, is vented through the discharge outlet so that no residual pressure develops in the consumer outlet.

14 Claims, 13 Drawing Figures

SAFETY VALVE ASSEMBLY

BACKGROUND OF THE INVENTION

The present invention relates to a safety valve assembly for pressure medium-operated consumer devices, particularly clutch and brake devices for presses. More particularly, it relates to a safety valve assembly which has two valves operating in parallel with one another and each having a working piston and a valve member, the valve members correspondingly controlling the connections between a supply inlet, a consumer outlet and a return outlet provided in a housing of the assembly.

Of late, the requirement has been made in this known type of safety valve assembly that in the event of a malfunction practically no residual pressure must remain in the consumer outlet of the valve assembly. The known safety valve assemblies are not satisfactory in the sense of the above-mentioned requirements.

SUMMARY OF THE INVENTION

Accordingly, it is an object of the present invention to provide a safety valve assembly for pressurized medium-operated devices, which avoids the disadvantages of the prior art.

More particularly, it is an object of the present invention to provide a safety valve assembly for pressurized medium-operated devices, in which in the event of a malfunction practically no residual pressure remains in the passage which leads to the consumer device.

In keeping with these objects and with others which will become apparent hereinafter, one feature of the present invention resides, briefly stated, in a safety valve assembly in which two valve members are guided in two bores provided in a housing of the assembly, the bores being crosswise connected with each other by means of two passages. In such a construction in the event of a malfunction when one of the valve members does not block the passages and the supply inlet could be connected with the consumer outlet, the other valve member blocks the passages and thereby the above-mentioned connection does not take place so that the consumer outlet communicates only with the return outlet and no residual pressure remains in the former.

In accordance with a further feature of the present invention each of the cross passages extends from a supply side of one chamber to a discharge side of the other chamber, and up to a point located upstream of a valve seat for a respective one of the valve members.

Still another feature of the present invention is that the valve members are formed as pistons having central recesses communicating with the supply inlet, annular passages arranged to communicate with the cross passages, and transverse bores communicating the central recesses with the annular passages. The valve members are movable between a working position in which the annular passages communicate with the cross passages and thereby the supply inlet communicates with the consumer outlet through the piston-shaped valve members, and a neutral position in which the piston-shaped valve members block the cross passages so that the consumer outlet does not communicate with the supply inlet.

As mentioned above, in the event of a malfunction one valve member communicates the supply inlet with the cross passages, whereas the other valve member blocks the passages. In other words, one valve member is left in the working position, whereas the other valve member is in the neutral position. In accordance with a further feature of the present invention, means are provided for establishing the presence of a malfunction, operative in response to these differing positions of the valve members and generating a fault signal for shutting down the consumer device.

A still further feature of the present invention is that the establishing means includes two pressure switches each having one side connected with the supply inlet and another side connected with a respective one of the cross passages communicating the chambers with one another.

Yet a further feature of the present invention is that the establishing means includes two transmitters operative for contactlessly sensing the above-mentioned differing positions of the valve members. The transmitters may be inductively or capacitively operated. Metallic sleeves may be arranged on the valve members at the side facing toward the transmitters so as to overlap the latter.

In accordance with still a further feature of the present invention the establishing means includes two pressure switches each having one side connected to one of the cross passages, and another side connected to a valve seat of the valve member of one valve and to a valve seat of the working piston of the same valve.

An additional feature of the present invention is that the establishing means includes two pressure switches each having one side which is connected with one of the cross passages, and another side which is connected with the consumer outlet through a further passage provided in this housing.

The novel feature of the present invention which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
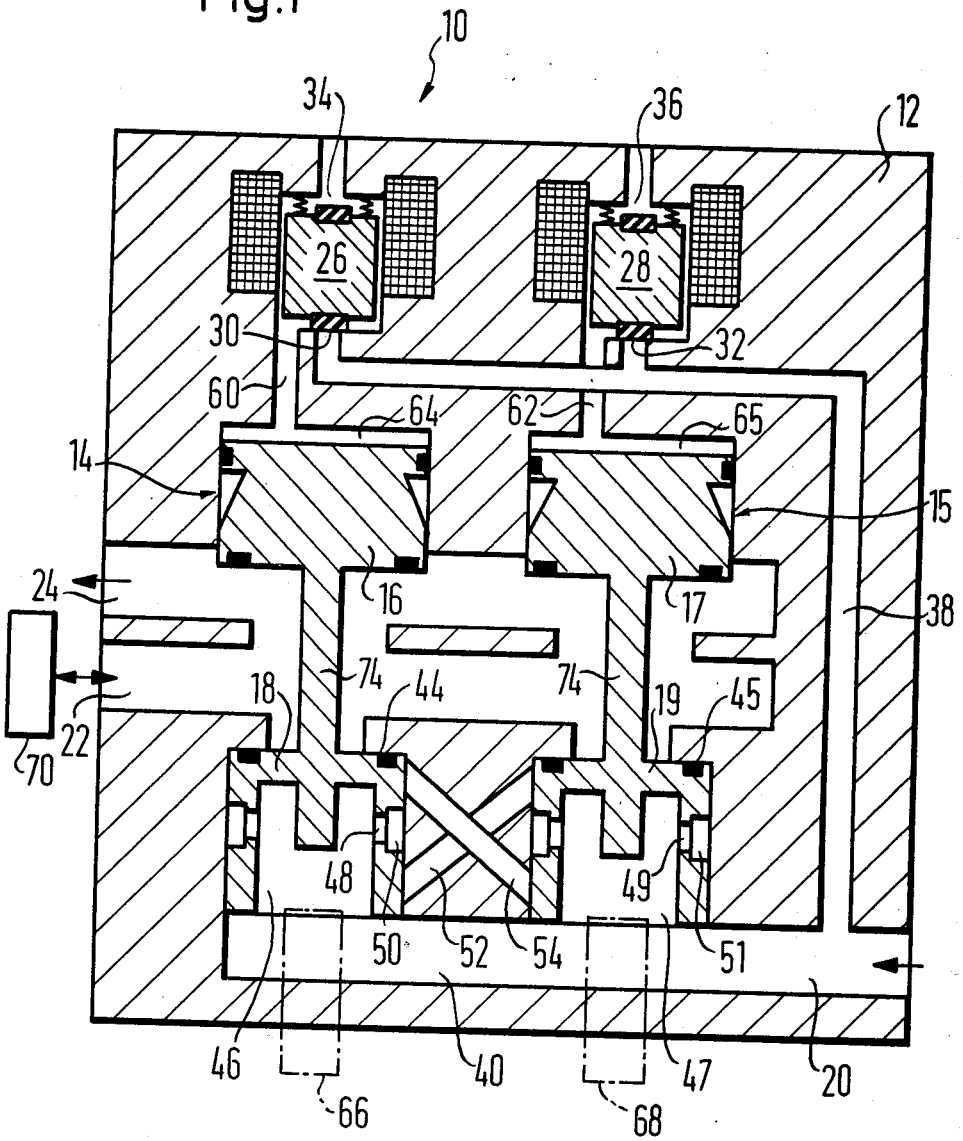
FIG. 1 is a view showing a section of a safety valve assembly in accordance with the present invention, in a neutral position.

FIG. 1 depicts a safety valve assembly 10, for example a safety valve assembly for a press. The valve assembly has a housing 12, and two valves 14 and 15 which are located in the housing parallel to one another and movable in the direction of their axis. Each of the valves 14 and 15 has a working piston 16 or 17 and a valve member 18 or 19 connected with a respective one of the working pistons by a stem 74.

The housing is provided with a supply inlet 20 for supplying a pressurized medium, for example compressed air, a consumer outlet 22 which is connected, for example, to a clutch and brake of a press, and a return outlet 24 which is vented, for example, to the atmosphere.

The valves 14 and 15 are actuated, for example, by electromagnetically operated servo valves 26 and 28 having valve seats 30 and 32 which communicate via a passage 38 with the inlet port 20, and further valve seats 34 and 36 which are vented, for example, to the atmosphere.

The pressurized medium flows from the inlet port 20 via a passage 38, the servo valves 26 and 28, and passages 60 and 62, and acts upon the working pistons 16 and 17. Then, when the valve seats 30 and 32 of the servo valve are open, the pressurized medium flows into chambers 64 and 65 above the end faces of the working pistons 16 and 17. The working pistons are provided with suitable locking portions which cooperate with valve seats 42 and 43, shown in FIG. 2, in order to establish or interrupt the communication between the consumer outlet 22 and the return outlet 24.

Such portions are known per se in the art and for this reason are not described herein in detail.

Figure 2:
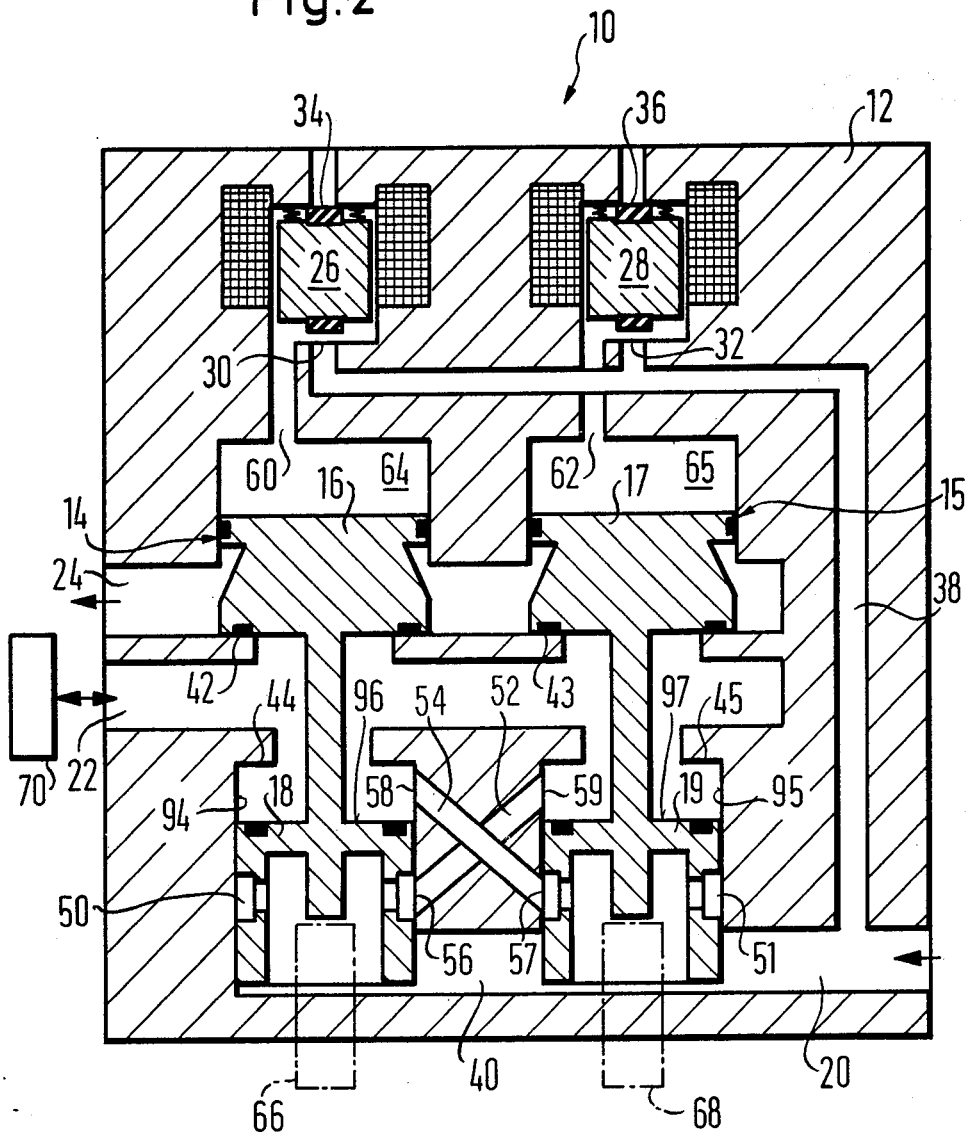
FIG. 2 is a view showing a section of the safety valve assembly of FIG. 1 in an operative position.

The valve members 18 and 19 are likewise provided with suitable locking portions which cooperate with valve seats 44 and 45, as shown in FIG. 2, in order to establish and interrupt the communication between the inlet port 20 and the outlet port 22, in dependence upon the positions of the valves 14 and 15.

Figure 3:
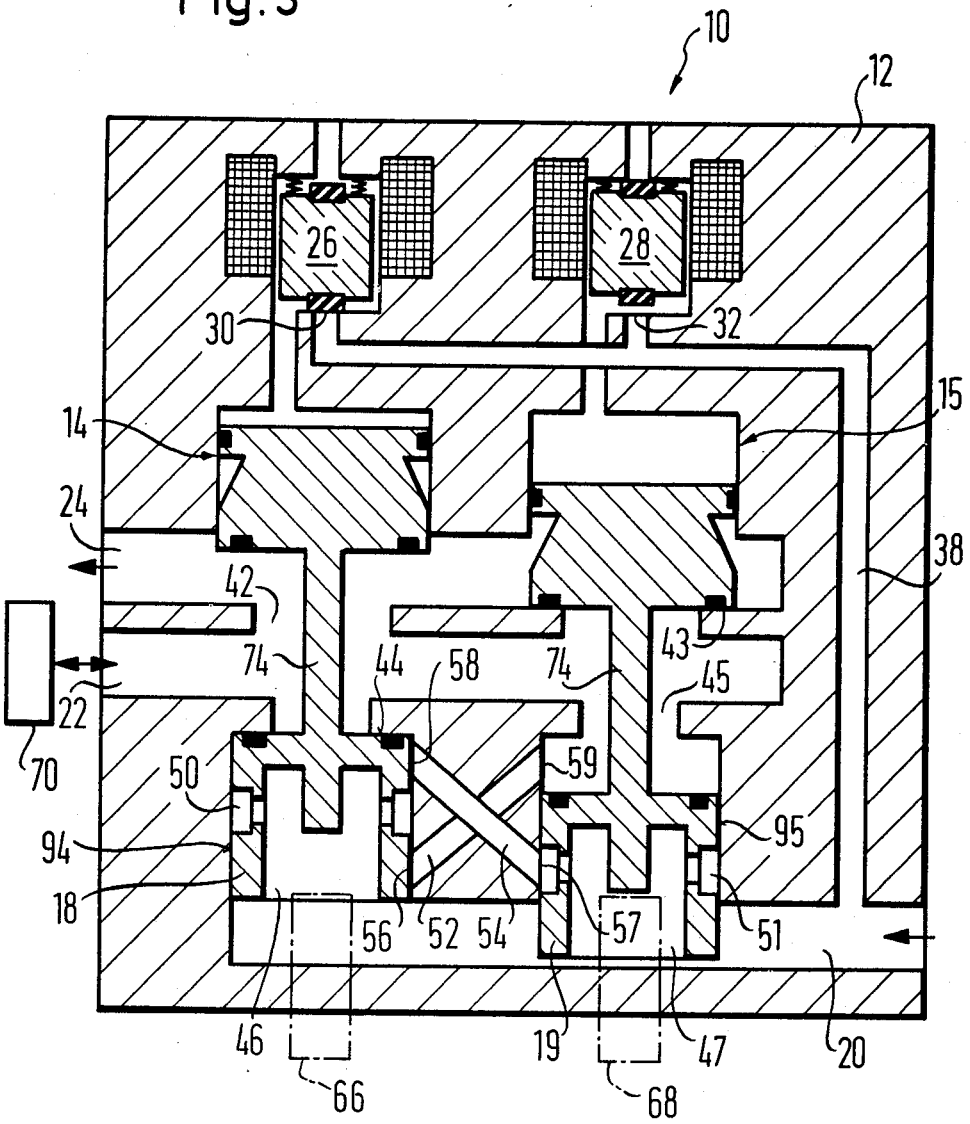
FIG. 3 is a view showing a section of the valve assembly of FIGS. 1 and 2 in the event of a malfunction.

The valve members 18 and 19 are formed as pistons which are guided in chambers 94 and 95 provided in the housing 12, as shown in FIG. 3. The thus-formed valve members have central axial recesses 46 and 47, annular passages 50 and 51, and transverse bores 48 and 49 each communicating the central recess of one valve member with the annular passage of the same valve member. The central recesses 46 and 47 directly communicate with the supply inlet 20 through a connecting passage 40 so that the pressurized medium is fed directly and in parallel from the supply inlet 20 to the central recesses 46 and 47 of the valve members 18 and 19.

The chambers 94 and 95 in which the valve members 18 and 19 are guided, are connected with each other by two crosswise extending connecting passages 52 and 54. The connecting passage 52 extends from an inlet side 56 of the chamber 94 to an outlet side 59 of the chamber 95. The connecting passage 54 extends from an inlet side 57 of the chamber 95 to an outlet side 58 of the chamber 94. The passages 52 and 54 cross each other, as mentioned above, but do not communicate with each other.

The safety valve assembly in accordance with the present invention operates in the following manner:

The safety valve assembly is shown in FIG. 1 in a neutral position. In this position the valve seats 30 and 32 of the servo valves 26 and 28 are both closed, and the chambers 64 and 65 above the working pistons 16 and 17 are vented through the passages 60 and 62 and the valve seats 34 and 36. Thereby, the valve members 18 and 19 are subjected to the full pressure of the pressurized medium flowing from the supply inlet 20 via the passage 40, so that they are pressed against and close their valve seats 44 and 45, as shown in FIG. 1. Contrary to this, the valve seats 42 and 43 with which the working pistons cooperate, are open. The flow of the pressurized medium to the consumer outlet 22 is thus blocked, and the communication between the consumer outlet 22 and the return outlet 24 is established so that a consumer device 70, for example the clutch and the brake of a press, is vented through the return outlet 24.

The passages 52 and 54 are blocked by the piston-like valve members 18 and 19, and in the position shown in FIG. 1, that is in the neutral position, no pressurized medium would in any case be able to flow through the passages 52 and 54 because the valve seats 44 and 45 are closed.

FIG. 2 shows the safety valve assembly 10 in the operative position. The servo valves 26 and 28 are actuated and thereby their valve seats 30 and 32 are open, whereas their valve seats 34 and 36 are closed. The pressurized medium flows then from the supply inlet 20 via the passage 38 to and through the valve seats 30 and 32, and from them through the passages 60 and 62 into the chambers 64 and 65 above the end faces of the working pistons 16 and 17. The working pistons are thereby, like the valve members 18 and 19, subjected to the pressure of the pressurized medium flowing from the inlet. Since the effective area of the working pistons 16 and 17 is greater than that of the respective valve members 18 and 19, the valves are shifted from the position shown in FIG. 1 into the position shown in FIG. 2, whereby the valve seats 42 and 43 are closed by the working pistons 16 and 17, and the valve seats 44 and 45 are opened by the valve members 18 and 19.

The consumer outlet 22 is thereby disconnected from the return outlet 24 and, instead of this, is connected with the supply inlet so that the pressurized medium can flow from the supply source to the consumer device. More particularly, the pressurized medium flows from the supply inlet 20 through the passage 40 into the central recesses 46 and 47 of the valve members 18 and 19 and from there passes through the transverse bores 48 and 49 into the annular passages 50 and 51 on the outer circumference of the piston-like valve members 18 and 19.

As shown particularly in FIG. 2, the annular passages 50 and 51 of the valve members, the passages lying in the transverse plane relative to the longitudinal edges of the valves, are so arranged that in the operative position shown in FIG. 2 they communicate with the inlet ends 56 and 57 of the passages 52 and 54 whose outlet end 58 and 59, as shown, are open behind the end faces of the valve members 18 and 19 into the chambers 94 and 95. In other words, they are open between the end faces 96 and 97 of the valve members 18 and 19 and the valve seats 44 and 45 which are open in the operative position shown in FIG. 2.

Thereby, the pressurized medium flows from the annular passage 50 of the valve member 18 through the connecting passage 52 in the chamber 95 of the other valve member 19, and from there through the open valve seat 45 to the consumer outlet 22. It further flows from the annular passage 51 of the valve member 19 through the connecting passage 54 into the chamber 94 of the valve member 18, and from there through the open valve seat 44 also to the consumer outlet 22. Thus, with the aid of the passages 52 and 54 which cross but are not connected to each other, the pressurized medium flows from one valve member to and through the valve seat of the other valve member and then to the consumer device.

If a malfunction occurs, as shown in FIG. 3, then practically no residual pressure must be allowed to remain in the consumer outlet 22. As shown in FIG. 3, the left valve 14 is in the neutral position while the right valve 15 is in the operative position. Such condition can, for example, occur when the servo valve 26 fails to open the valve seat 30 in the operative position, or the servo valve 28 fails to close the valve seat 32 when switched to the neutral position (or vice versa).

The valve seat 44 of the left valve member 18 is closed so that no pressurized medium can pass therethrough at this point and to the consumer device. The valve seat 45 of the right valve member 19 is thereby open. The pressurized medium flows from the supply inlet 20 into the central recesses 46 and 47 of the valve members and from there through the transverse bores into the respective annular passages 50 and 51. However, the pressurized medium cannot flow out of the annular passage 50, inasmuch as the latter, as shown in FIG. 3, is overlapped and blocked by the housing. The pressurized medium cannot flow into the connecting passage 52, inasmuch as the inlet end 56 thereof is blocked by the piston-like valve member 18. The pressurized medium flowing into the annular passage 51 of the right valve member 19 can, on the other hand, flow out of the annular passage further through the inlet end 57 of the connecting passage 54. However, as shown in FIG. 3, the discharge end 58 of the passage 54 is blocked by the valve member 18 so that here, also, the pressurized medium cannot flow any further.

Since the valve seat 42 with which the working piston 16 cooperates, is open, there is free communication between the consumer outlet 22 and the return outlet 24 so that the consumer device is vented to atmosphere. Since through the open valve seat 43 of the right valve member 19 practically no pressurized medium can flow, no residual pressure can develop in the consumer outlet 22. The safety valve assembly in accordance with the described embodiment thus reliably prevents development of residual pressure in the line of the consumer device in the event of malfunction.

Precautions must be taken, furthermore, to ensure that the presence of a malfunction is established and the device is shut down. Means for establishing the presence of malfunction is provided in the safety valve assembly in accordance with the present invention. This means can be formed as inductively operated or capacitively operated transmitters 66 and 68 which contactlessly sense the positions of the valve members 18 and 19. In the event of a malfunction the signal outputs of the transmitters 66 and 68 are different whereby a fault signal is generated which can be used to shut down the device.

Instead of or in addition to this, two pressure valves may be used, which sense the pressure in the connecting passages 52 and 54 and compare it with the feed pressure in the supply passage 20.

Figure 4:
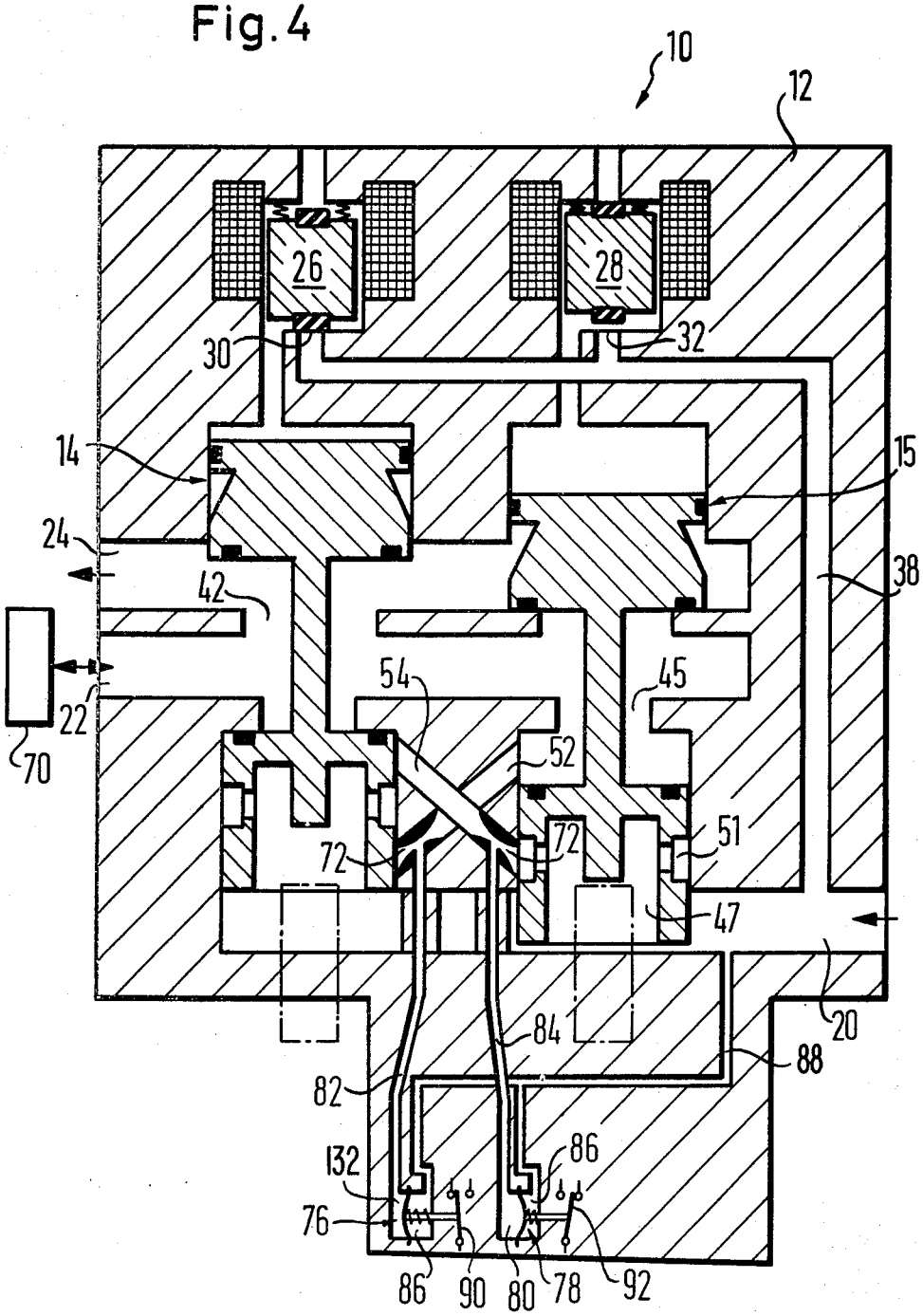
FIG. 4 is a view showing a section of the valve assembly in accordance with another emboodiment of the present invention.

FIG. 4 shows the safety valve assembly in accordance with such an embodiment, wherein the assembly is in condition of a malfunction and thereby the valve members are in the same position as in FIG. 3. With reference to FIG. 3, it was explained that in the event of the malfunction the full feed pressure is present in the connecting passage 54, whereas the connecting passage 52 is blocked against the supply of pressurized medium so that in this connecting passage, which communicates through the valve seat 45 and the valve seat 42 with the return outlet 24, the exhaust pressure, i.e. practically atmospheric pressure develops.

In each of the pressure switches 76 and 78 a feed pressure is on one side 86, since this side communicates with the supply inlet 20 through a conduit 88. On a side 80 of the pressure switch 78 which communicates via a conduit 84 with the connecting passage 54, there is likewise full feed pressure since, as already explained, the passage 54 is connected with the supply inlet 20 through the annular passage 51 and the central recess 47, so that the feed pressure prevails in the passage 54.

On the side 132 of the pressure switch 76, on the other hand, the side communicating with the connecting passage 52 through a conduit 82, there is atmospheric pressure because, as also has been explained, the connecting passage 52 is vented to the atmosphere. The pressure switch 76 assumes thereby a different position as compared with that of the pressure switch 78. The pressure switches actuate, as illustrated, electrical contacts 90 and 92 and their circuitry is so formed that in the event of the different switching positions they emit a fault signal which can be used for shutting down the installation. The electrical contacts 90 and 92 may be diaphragm-actuated. If necessary, a constriction 72 may be provided in each of the connecting passages 52 and 54.

Figure 5:
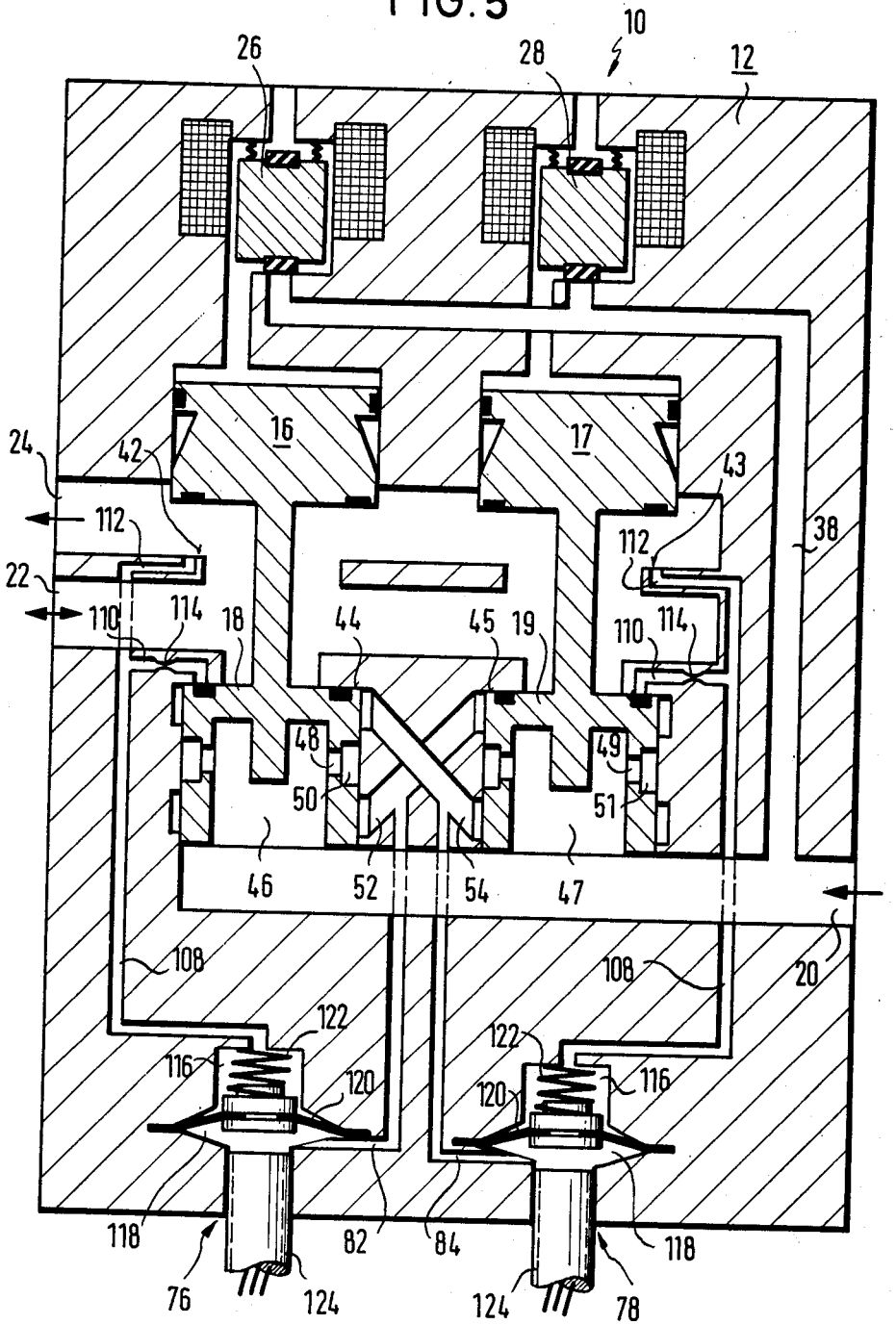
FIGS. 5–7 are sections of the safety valve assembly in accordance with still another embodiment of the present invention, in the positions corresponding to those of FIGS. 1–3.
Figure 6:
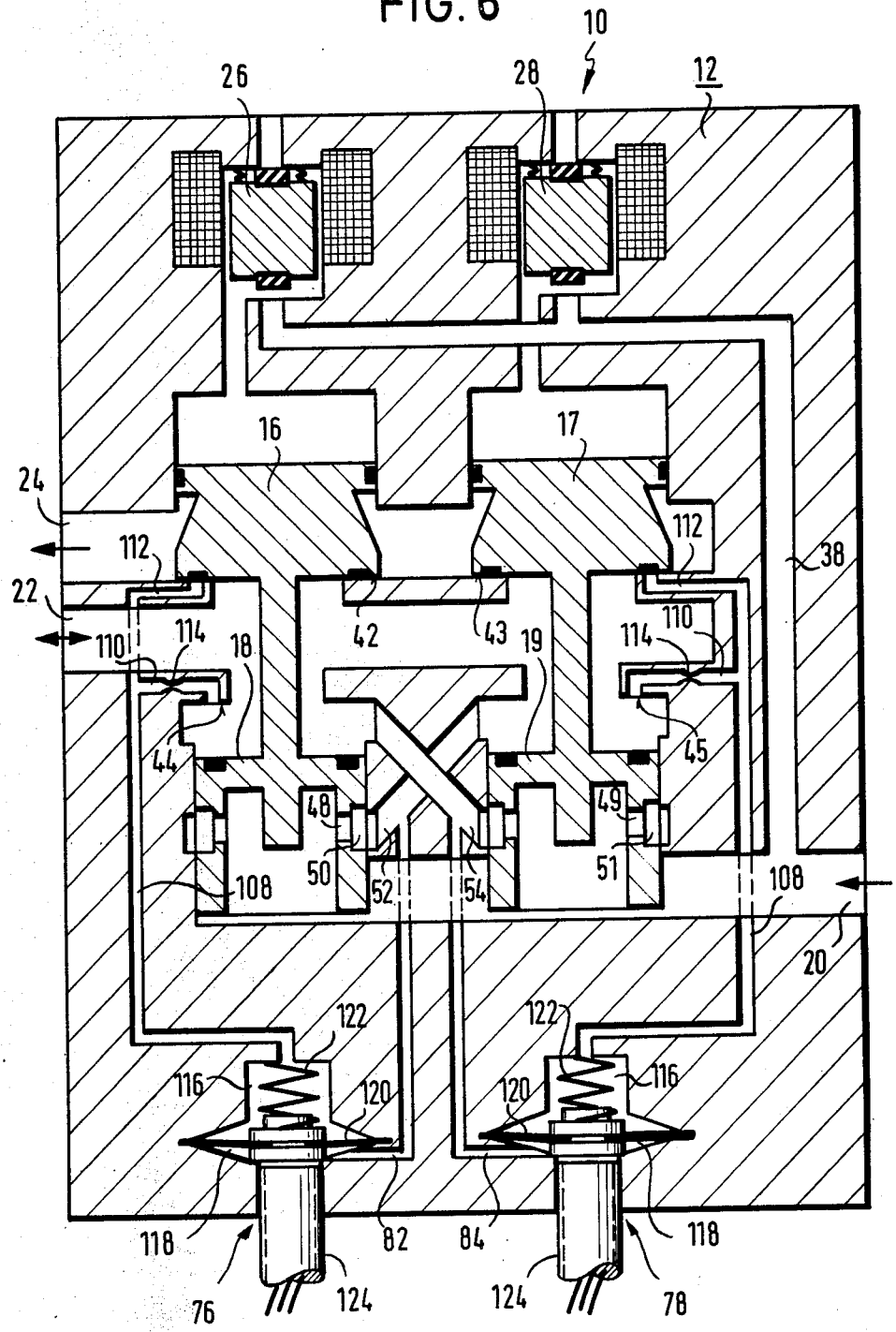
Figure 7:
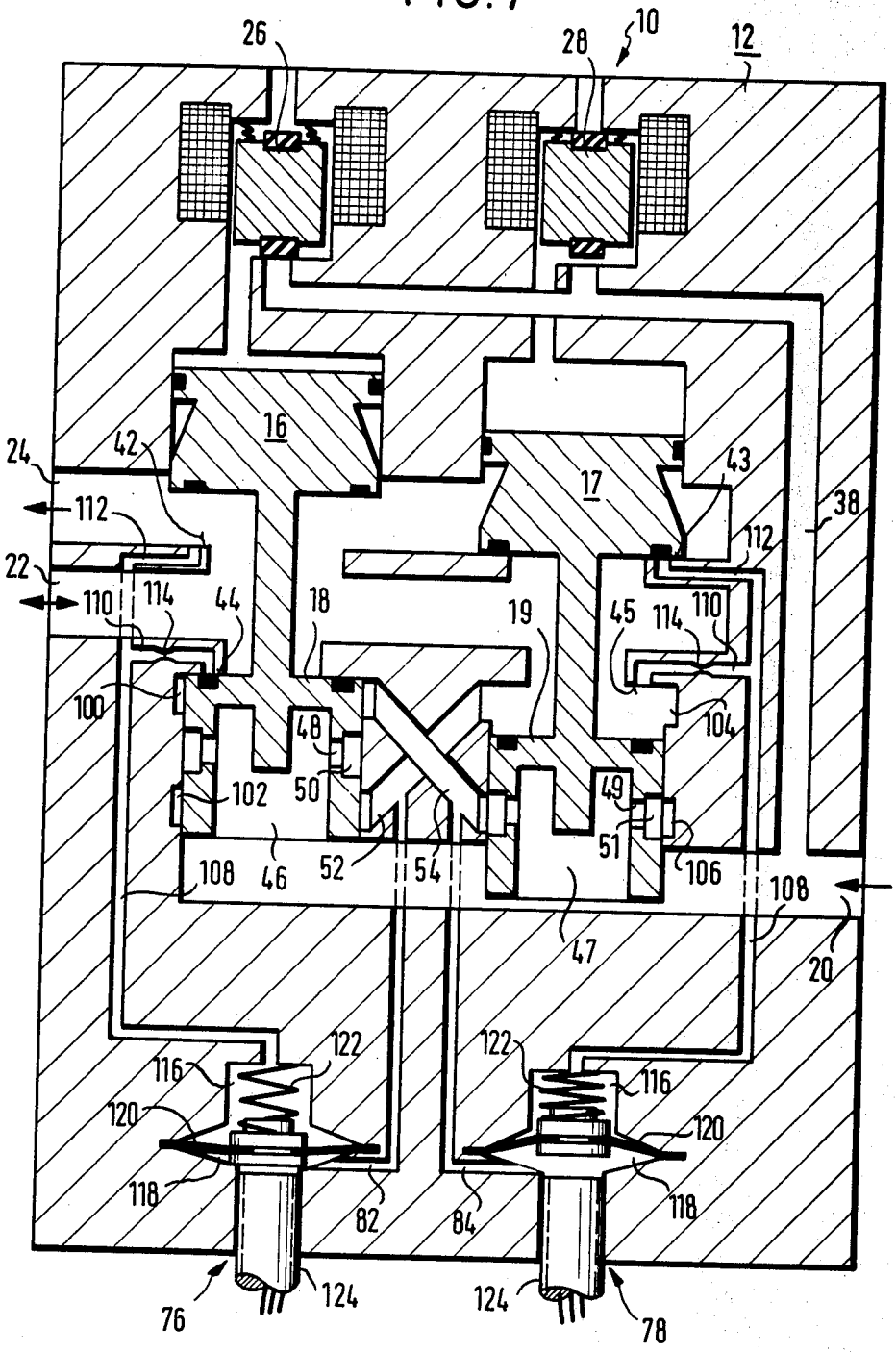

FIGS. 5–7 show still another embodiment of the safety valve assembly in accordance with the present invention, in which the sealing of the valve members and working pistons are monitored with respect to possible leakage. The pressure switches 76 and 78 are each provided with a diaphragm 120 separating two chambers 116 and 118 from one another. They are also provided each with a pressure spring 122 which urges the respective diaphragms 120 in a given switching direction. Each of the pressure switches is provided with an electric contact 124 which operates in accordance with the position of the membrane 120 of the respective pressure switch. The chambers 118 of the pressure switches are connected by the conduits 82 and 84 with the respective connecting passages 52 and 54, whereas the chambers 116 are connected by conduits 108 and 110 with the valve seats 44 and 45 of the valve members 18 and 19 as well as through the conduit 108 and the conduit 112 with the valve seats 42 and 43 of the working pistons 16 and 17. In other words, the passages 110 and 112 are open into the valve seats 42 and 43 as well as 44 and 45 of the working pistons and the valve members, respectively. A constriction 114 is provided in each of the passages 110.

FIG. 5 shows the safety valve assembly in the neutral position wherein the valve seats 44 and 45 are closed and the valve seats 42 and 43 are open, i.e. the passages 112 are vented, whereas the passages 110 are closed. Thereby, the pressure in the return outlet 24, e.g. as a rule atmospheric pressure, prevails in the chambers 116 of the pressure switches. In the connecting passages 52 and 54 there is a working pressure, for example from the previous operative position, or the working pressure can develop in the passages 52 and 54 through the clearance between the valve members 18 and 19 and the housing. Since the chambers 118 of the pressure switches communicate with the connecting passages 52 and 54 through the passages 82 and 84, the working pressure prevails in the chambers 118. The force resulting therefrom exceeds the force of the spring 122 so that the diaphragms 120 assume the position shown in FIG. 5, the position of the diaphragms being the same in both pressure switches.

In the operative position shown in FIG. 6, the valve seats 42 and 43 are closed, but the valve seats 44 and 45 are open so that the pressurized medium can flow from the supply inlet 20 through the connecting passages 52 and 54 and the valve seats 44 and 45 to the consumer outlet 22. At the mouth of the passage 110 thereby the working pressure prevails, and similarly at the mouth of the passages 82 and 84 in the connecting passages 52 and 54. Thus, the chambers 116 and 118 of the pressure switches 76 and 78 are subjected to the working pressure. Since the pressure spring 122 is located in the chamber 116, the diaphragms are switched over and assume the position shown in FIG. 6, wherein the positions of both diaphragms are the same also. Two electrical contacts 124 are switched over, but they are so operated that they only trigger an alarm or shut down the installation when they meet different signals, in the case when the diaphragms of the pressure switches assume different switched positions. Such different positions are shown in FIG. 7 wherein the valve member 18 first assumes the neutral position whereas the valve member 19 assumes the operative position, so that a malfunction results. The passage 112 of the pressure switch 76 is vented to the return outlet 24, whereas the passage 110 is closed so that the chamber 116 of the switch 76 is likewise vented. The connecting passage 52 is also vented through the valve seat 45 and the valve seat 42, and thereby also the chamber 118 of the pressure switch 76 which is connected through the passage 82 with the connecting passage 52. Since the same pressure prevails in the chambers 116 and 118, the diaphragm 120 of the pressure switch 76 is urged by the spring 122 into the operative position shown in FIG. 7.

As for the pressure switch 78, the passage 112 thereof is closed, the passage 114, however, is open at the valve seat 45 so that the atmospheric pressure also prevails in the chamber 116 of this pressure switch. Contrary to this, in the chamber 118 of the pressure switch 78, which is connected with the connecting passage 54 through the passage 84, the working pressure prevails, since the connecting passage 54 is not vented. For this reason, from the previous operational position, the working pressure can develop through the piston clearance between the valve member and the housing. Since in the chamber 118 of the pressure switch 78 the working pressure prevails, the diaphragm 120 of the pressure switch 78 is urged against the force of the spring 122 into the operative position shown in FIG. 7. Thus, the operative positions of the diaphragms 120 of the pressure switches 76 and 78 are different so that, as already mentioned, the electrical contact 124 associated with the pressure switches emit different signals which are used to shut down the installation.

If, for example, a leakage occurs at the valve member 19, i.e. between it and its valve seat 45 in the neutral position, then the connecting passage 52 will be vented through the valve seat 45 to the return outlet 24 if this leak is greater than the amount that can, if required, flow through the piston clearance between the valve member 18 and the housing, into the passage 52. The piston clearance can be kept to the minimum in accordance with the manufacturing criteria and practical requirements. If now the passage 52 is vented to atmosphere, then the diaphragm of the pressure switch 76 is switched over so that it assumes the position shown in FIG. 7, whereas the diaphragm of the pressure switch 78 remains in the position shown in FIG. 5. Since the diaphragm assumes different positions, the electric contacts 124 emit different signals which result in shutting down of the installation.

The same considerations apply if there is a leak at the valve member 18. If, on the other hand, in the positions shown in FIG. 6, a leak occurs for example at the working piston 17, i.e. in the valve seat 43, then the passage 112 of the pressure switch 78 is vented to the return outlet 24 and the pressure in the passage 108 of the pressure switch 78 collapses being subjected to the leak which is greater at the working piston 17 than the amount which can flow from the open valve seat 45 through the constriction 114 in the passage 110. If this is the case, i.e. if this leak is greater than the amount of pressurized medium which can flow through the constriction 114, then the chamber 118 of the pressure switch 78 is vented to atmosphere whereas the chamber 118 of the pressure switch 76 is subjected to the working pressure. Thereby, the membrane 120 of the pressure switch 78 is switched over so that it assumes the position shown in FIG. 7 whereas the diaphragm 120 of the pressure switch 76 remains in the position shown in FIGS. 6 and 7, so that again the diaphragms assume different positions. Thereby different signals are emitted by the electrical contacts 124 so that, as already explained, the installation is shut down. The same considerations apply if there is a leak at the working piston 16.

If the diaphragm 120 in one of the pressure switches 76 and 78 ruptures, then in this switch only the respective pressure spring 122 will be effective, so that this diaphragm can no longer be operated. This means that at the next switching over of the diaphragm of the other pressure switch, the diaphragms of the pressure switches will assume different positions which will be an indication of a malfunction and which result in shutting down of the installation. On the other hand, if the spring 122 in one of the pressure switches breaks, then the respective diaphragm will assume the neutral position shown in FIG. 5 and will remain there.

Figure 8:
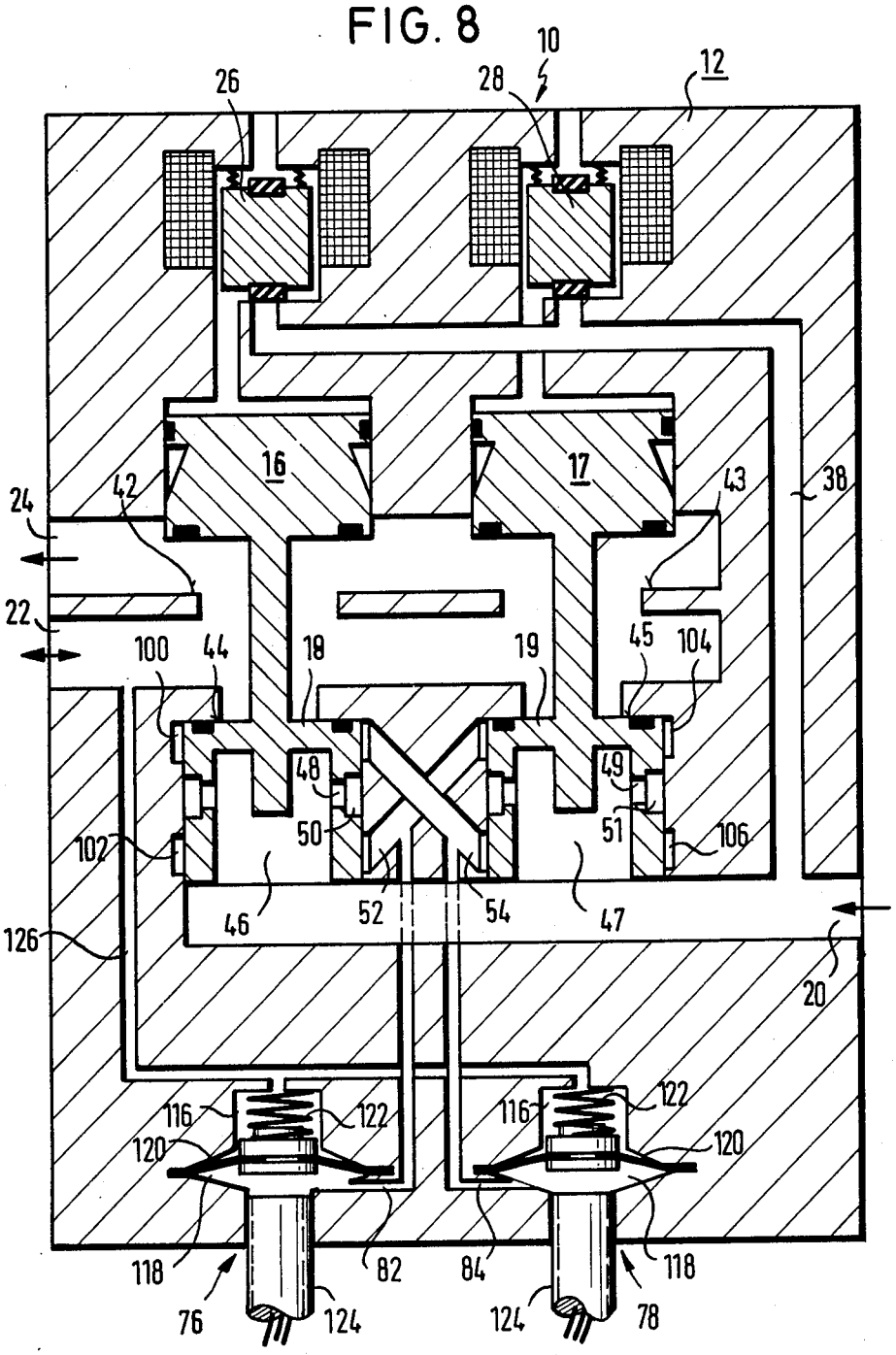
FIGS. 8–10 are views showing sections of the safety valve assembly in accordance with a further embodiment of the present invention, in the positions corresponding to those of FIGS. 1–3.
Figure 9:
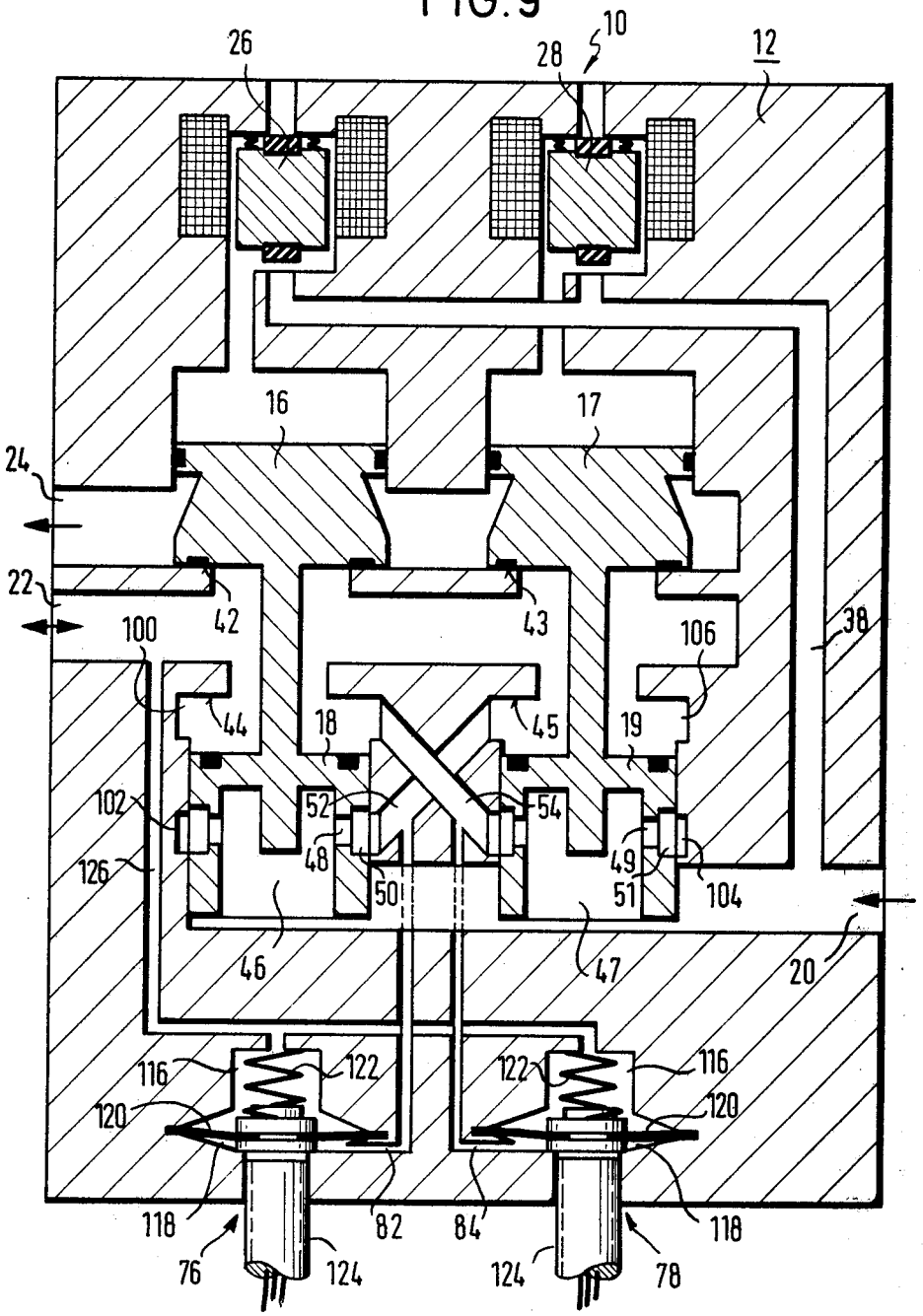
Figure 10:
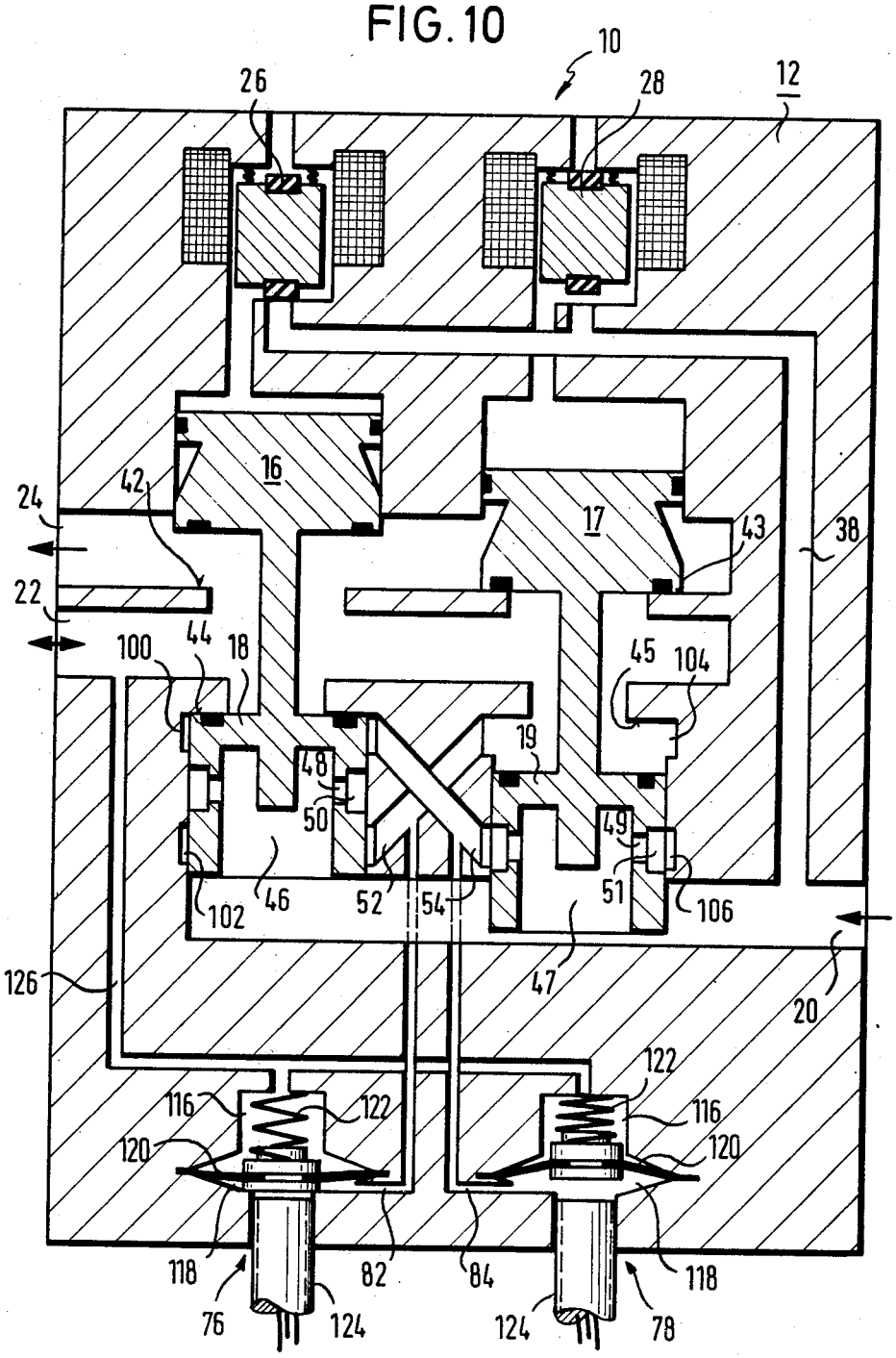

FIGS. 8–10 show a further embodiment of the safety valve assembly in accordance with the present invention wherein FIG. 8 shows the neutral position, FIG. 9 shows the operative position, and FIGS. 10 shows a malfunction. In accordance with this embodiment, the chambers 116 of the pressure switches 76 and 78 are connected directly to the consumer outlet 22 by a common passage 126. Thereby, the pressure, including the pressure build-up and pressure reduction in the consumer outlet 22 can be monitored. In the neutral position shown in FIG. 8, the valve seats 44 and 45 are closed and the valve seats 42 and 43 are open so that the consumer outlet 22 is vented to the return outlet 24, i.e. vented to the atmosphere. The chambers 116 of the pressure switches are therefore also vented through the passage 126, whereas the chambers 118 are connected through the passages 82 and 84 to the passages 52 and 54 which are subjected to the working pressure as has been explained in connection with the embodiment shown in FIGS. 5–7. The membranes 120 assume the positions corresponding to those shown in FIG. 5, whereby both diaphragms occupy the same positions. In the operative position shown in FIG. 9, the valve seats 44 and 45 are open and the valve seats 42 and 43 are closed, i.e. the pressurized medium flows from the supply inlet 20 through the valve members 18 and 19 and the connecting passages 52 and 54 to the consumer outlet 22. The chambers 118 of the pressure switches are subjected to the working pressure, inasmuch as the connecting passages 52 and 54 communicate with the supply inlet 20. However, since the consumer outlet 22 is also subjected to the working pressure, the working pressure also prevails in the chambers 116 of the pressure switches since they communicate through the passage 126 with the consumer outlet 22. The diaphragms of the pressure switches are switched over and assume the position shown in FIG. 9.

In the event of the malfunction shown in FIG. 10 the valve member 18 is in the neutral position whereas the valve member 19 is in the operative position. The consumer outlet 22 is vented through the valve seat 42 of the working piston 16 to the return outlet 24. Thereby both chambers 116 of the pressure switches are vented through the passage 126. The connecting passage 52 is also vented to atmosphere through the open valve seat 45 of the valve member 19, and thus the chamber 118 of the pressure switch 76 which is connected to it through the passage 82. Since the same pressure prevails in both chambers 116 and 118 of the pressure switch 76, the diaphragm 120 is subject only to the action of the pressure spring 122 whereby it is urged into the position shown in FIG. 10. The chamber 118 of the pressure switch 78 communicates through the passage 84 with the connecting passage 54 which is subjected to the working pressure, because it communicates with the supply inlet 20. The diaphragm 120 of the pressure switch 78 is therefore switched into the position shown in FIG. 10, inasmuch as its one side in the chamber 118 is subjected to the working pressure, whereas its other side in the chamber 116 is subjected to the atmospheric pressure, the working pressure overcoming the force of the spring. Therefore, in the event of a malfunction the diaphragms of the pressure switches 76 and 78 assume different positions, and the electrical contact 124 coupled therewith emit different signals so that, as explained in connection with the embodiments shown in FIGS. 5–7, the installation is shut down.

A malfunction also occurs if, for example, the valve member 19 does not, as shown in FIG. 10 pass fully into the operative position, but lifts only to a small extent from its valve seat 45, whereas the valve member 18 remains in the neutral position. In this case the connecting passage 52 is also vented, whereas the connecting passage 54 is subjected to the working pressure.

Figure 11:
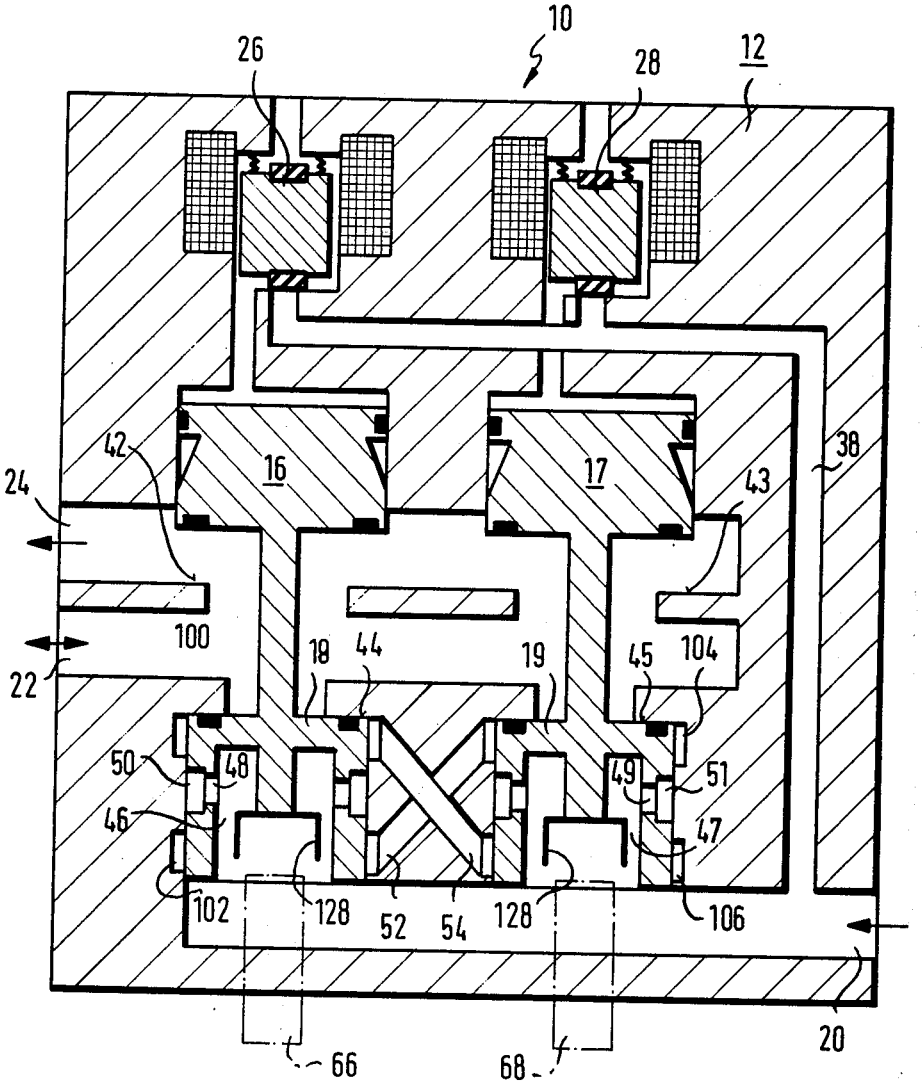
FIGS. 11–13 are views showing sections of the safety valve assembly in accordance with a still further embodiment of the present invention, also in the positions corresponding to those of FIGS. 1–3.
Figure 12:
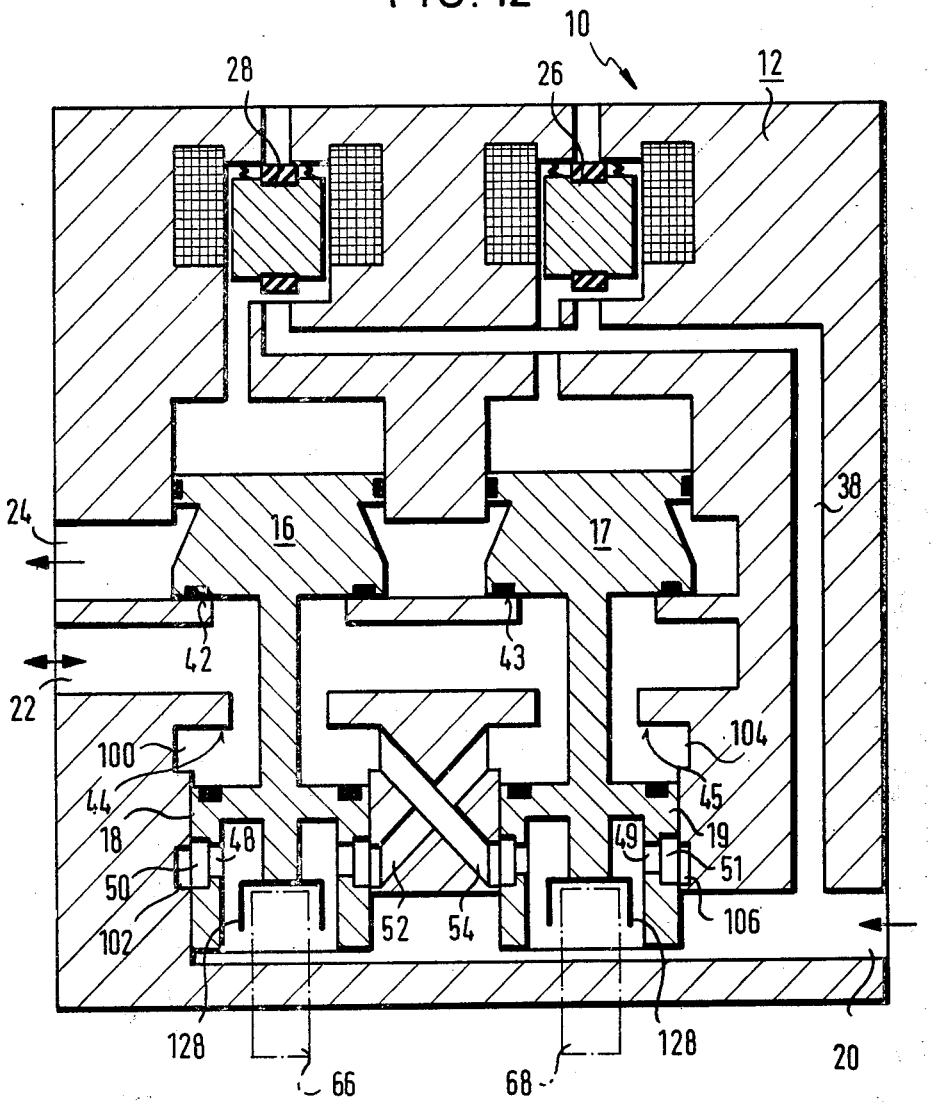
Figure 13:
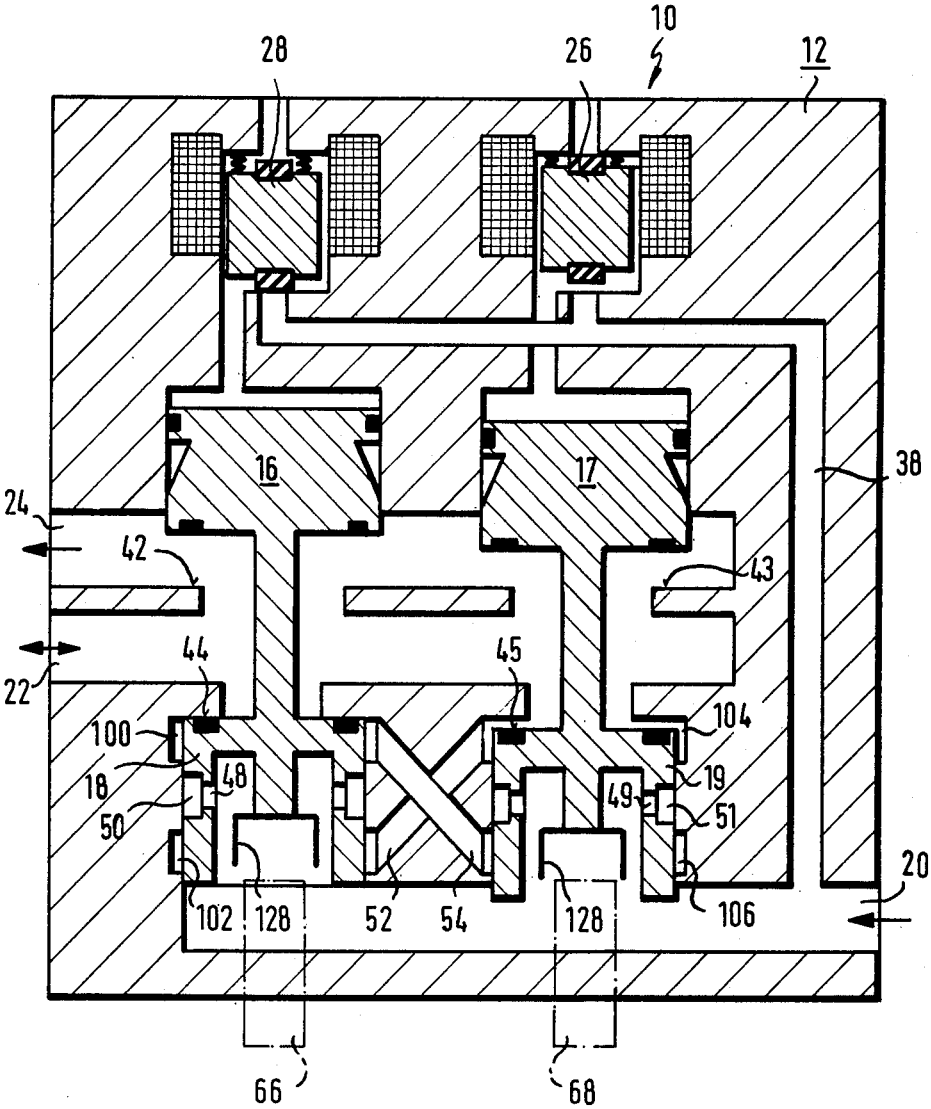

FIGS. 11–13 show the safety valve assembly in accordance with a still further embodiment of the present invention wherein the assembly is respectively in the neutral position, operative position and a malfunction. The safety valve assembly is provided with the contactless transmitters 66 and 68 which act, for example, inductively or capacitively and monitor the positions of the valve members 18 and 19. In the neutral position shown in FIG. 11 and in the operative position shown in FIG. 12, the transmitters 66 and 68 emit the same signals which have no consequences, whereas in the case of a malfunction shown in FIG. 13 they emit different signals inasmuch as in the event of a malfunction the positions of the valve members differ from one another. The transmitters 66 and 68 are connected to a not shown electric circuit which shuts down the installation when the transmitters emit different signals.

The valve members 18 and 19 are provided with metallic sleeves 128 located at the sides which face toward the transmitters 66 and 68. The transmitters 66 and 68 are so adjusted that in the neutral position shown in FIG. 11 they do not respond. However, in the operative position shown in FIG. 12 the sleeves 128 overlap the transmitters 66 and 68 whereas the latter are actuated, but since they emit the same signals, this has no consequences. When in the case of a malfunction the valve member 18 remains in the neutral position shown in FIG. 1 whereas the valve member 19 assumes the operative position shown in FIG. 12, then the transmitters 66 and 68 emit different signals, and the installation will be shut down, as already explained. If, however, as shown in FIG. 13 the valve member 19 lifts only to a small extent from its valve seat 45, whereas the valve member 18 remains in the inoperative position, then even this small proximity of the sleeve 128 to the transmitter 68 results in switching over of the latter and thereby emitting a false signal which is used for shutting down the installation.

If, on the other hand, the valve members were not to be provided with sleeves 128, then the slight movement of the valve member 19 would not be sufficient to switch over the transmitter 68, although a malfunction might occur, inasmuch as only the valve member 19 has lifted, however slightly, from its valve seat 45. This can occur, for example, inasmuch as by jamming between the valve member and the housing, the valve member 19 has not closed completely or has lifted only to a small extent from its valve seat 45. Thus, the transmitter 66 and 68 respond if the valve members 18 and 19 lift to only a very small extent, i.e. by 0.1 to 0.2 mm, of their seats 44 and 45.

The above-described embodiment wherein the safety valve assembly includes two transmitters 66 and 68 has the advantage that even in the event of small movement of the valve member, i.e. particularly immediately after lifting of the valve members from their valve seats, the electric transmitters respond and the installation is shut down in the event of a malfunction. For the purpose of better supply of the pressurized medium to and discharge of the same from the connecting passages 52 and 54, respective annular passages 100, 102, 104 and 106 are provided in the housing, as shown particularly in FIG. 7.

It will be understood that each of the elements described above, or two or more together, may also find a useful application in other types of constructions differing from the types described above.

While the invention has been illustrated and described as embodied in a safety valve assembly for pressurized medium-operated devices, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A safety valve assembly for pressurized-medium operated devices, particularly for use in clutch and brake arrangements of presses, comprising a housing having a supply inlet, a consumer outlet and a return outlet, said housing being formed with two separate chambers defining two first valve seats and two crosswise positioned non-intersecting passages for connecting said chambers to each other, each of said chambers having a supply side and a discharge side, each of said intersecting passages extending from the supply side of one chamber to the discharge side of the other chamber to a point located upstream of a respective one of said first valve seats; two valves operating in parallel with one another and each having a working piston and a valve member connected thereto, said valve members being guided within said chambers up to said first valve seats and each formed with a central recess, each of said recesses being associated with said supply inlet and operatively connected with respective ones of said nonintersecting passages, each of said valve members further including an annular passage and a transverse bore connected to each other and arranged to operatively communicate each of said central recesses with respective ones of said non-intersecting passages; and means for controlling the operation of said valves to thereby establish or interrupt the communication between said inlet and said outlets selectively.

2. A safety valve assembly as defined in claim 1, wherein said controlling means is electromagnetic means.

3. A safety valve assembly as defined in claim 1, wherein said valves and thereby said valve members are movable between a working position and a neutral position, said annular passages of said valve member being so located that when said valve members are in said working position said annular passages and thereby said central recesses of said valve members are open into said nonintersecting passages connecting said chambers with one another so that said supply inlet communicates with said consumer outlet through said valve members, whereas when said valve members are in said neutral position said annular passages and thereby said central recesses of said valve members are disconnected from said nonintersecting passages connecting said chambers with one another and said valve members blocks said nonintersecting passages so that said supply inlet does not communicate with said consumer outlet.

4. A safety valve assembly as defined in claim 3, wherein said valves and thereby said valve members move between said working and neutral position independently from one another and so that, when a malfunction occurs and one of said valve members is in said working position wherein its central recess communicates with one of said nonintersecting passages connecting the chambers with one another, the other valve member is in said neutral position and blocks the other cross passage whereby said consumer outlet does not communicate with said supply inlet but, instead, communicates with said return outlet wherefore no residual pressure is retained in said consumer outlet.

5. A safety valve assembly as defined in claim 4, and further comprising means for establishing the presence of a malfunction, operative in response to said differing positions of said valve members and generating a fault signal.

6. A safety valve assembly as defined in claim 5, wherein said establishing means includes two pressure switches each having one side connected with said supply inlet and another side connected with a respective one of said nonintersecting passages so as to sense differing pressures in said nonintersecting passages resulting from differing positions of said valve members, as compared with the pressure in said supply inlet.

7. A safety valve assembly as defined in claim 5, wherein said establishing means includes two transmitters operative for contactlessly sensing said differing positions of said valve members.

8. A safety valve assembly as defined in claim 7, wherein said transmitters are inductively operating transmitters.

9. A safety valve assembly as defined in claim 7, wherein said transmitters are capacitively operating transmitters.

10. A safety valve assembly as defined in claim 7, wherein each of said valve members has a side facing toward a respective one of said transmitters and provided with a metallic sleeve which is arranged to overlap the latter.

11. A safety valve assembly as defined in claim 5, wherein said housing further including two second valve seats for each of said working pistons of said valves, said establishing means including two pressure switches each having one side connected to one of said nonintersecting passages, and another side connected to both the first valve seat of the valve member of a respective valve, and to the second valve seat of the working piston of the same valve.

12. A safety valve assembly as defined in claim 11, wherein a constriction is provided in each of said nonintersecting passages.

13. A safety valve assembly as defined in claim 5, wherein said establishing means includes two pressure switches each having one side which is connected with one of said nonintersecting passages, and another side which is connected with said consumer outlet.

14. A safety valve assembly as defined in claim 13, and further comprising means for connecting the other sides of the pressure switches with said consumer outlet, including two further passages formed in said housing and extending from the former to the latter.

* * * * *